United States Patent [19]

Fukuda et al.

[11] Patent Number: 4,915,749

[45] **Date of Patent: * Apr. 10, 1990**

[54] METHOD OF REDUCING IRON LOSS OF GRAIN ORIENTED SILICON STEEL SHEET

[75] Inventors: Bunjiro Fukuda; Keiji Sato; Eiji Hina, all of Chiba, Japan

[73] Assignee: Kawasaki Steel Corp., Japan

[ * ] Notice: The portion of the term of this patent subsequent to Sep. 20, 2005 has been disclaimed.

[21] Appl. No.: 180,250

[22] Filed: Apr. 11, 1988

[30] Foreign Application Priority Data

Apr. 17, 1987 [JP] Japan ..... 62-93361

[51] Int. Cl.[4] ..... H01F 1/04

[52] U.S. Cl. ..... 148/112; 219/121.36; 219/121.59

[58] Field of Search ..... 148/111, 112, 113; 219/121.36, 121.59

[56] References Cited

U.S. PATENT DOCUMENTS 4,772,338 9/1988 Fukuda et al. ..... 148/112

FOREIGN PATENT DOCUMENTS 57-2252 1/1982 Japan .
59-33802 2/1984 Japan .
59-92506 5/1984 Japan .

*Primary Examiner*—John P. Sheehan
*Attorney, Agent, or Firm*—Austin R. Miller

[57] ABSTRACT

The iron loss is reduced by irradiating plasma flame to the surface of the grain oriented silicon steel sheet, wherein the irradiation interval (l) of plasma flame is controlled so as to satisfy the following equation (1):

$$22-2.5D \leqq l \leqq 36-2.5D \quad (1)$$

(D is an average secondary recrystallized grain size of the steel sheet).

2 Claims, 3 Drawing Sheets

METHOD OF REDUCING IRON LOSS OF GRAIN ORIENTED SILICON STEEL SHEET

BACKGROUND OF THE INVENTION

1. Field of the Invention

This invention relates to a method of reducing iron loss of a grain oriented silicon steel sheet used in transformers and the like.

2. Related Art Statement

The iron loss of grain oriented silicon steel sheet is the heat energy loss generated in the sheet when using it as a core of a transformer or the like. Lately, the demand for reducing the heat energy loss or iron loss of the grain oriented silicon steel sheet has become higher in view of energy circumstances.

In order to reduce the iron loss, there have been attempted various methods, for example, a method wherein crystal grains of the steel sheet are highly oriented in {110}<001> orientation, a method wherein the Si amount is increased to raise the electrical resistance of the steel sheet, a method of reducing the impurity amount, a method of thinning the thickness of the steel sheet, and the like. However, the reduction of iron loss by these metallurgical methods has substantially reached its limit.

Therefore, there have been proposed various methods for the reduction of iron loss other than the above metallurgical methods. Among them, a method of reducing iron loss by irradiation with a pulse laser as described in Japanese Patent Application Publication No. 57-2,252 or the like, is industriallized at the present. Although this method makes it possible to largely reduce iron loss as compared with the case of using a conventional metallurgical method, it is difficult to avoid the increase of initial cost and running cost due to the fact that the apparatus used is expensive and the life of the lamp used for excitation of the laser is not so long. Further, the laser beam used is not often a visible light, so that it is always necessary to take a countermeasure from the viewpoint of safety.

Furthermore, in the above laser irradiation method, a strain which causes refinement of the magnetic domain is introduced by shock wave reaction due to the evaporation of surface coatings and a part of the base metal by the irradiation, so that it is required to repair the surface coatings by recoating. If the recoating is performed, the lamination factor inevitably becomes poor and the magnetic properties in the actual application are degraded. Moreover, if the base metal is excessively evaporated, the magnetic flux density of the steel sheet undesirably lowers.

In Japanese Patent laid open No. 59-33,802 and No. 59-92,506 is disclosed a method of irradiating a continuous laser beam, but this method has drawbacks that the effect of reducing iron loss is small, and the absorption rate of the laser beam by the steel sheet inevitably changes to make the effect variable in addition to the drawbacks similar to those described on the pulse laser method.

As a method substituting for the above methods, the inventors have previously proposed a method of irradiating a plasma flame to the surface of the steel sheet and filed as Japanese Patent Application No. 60-236,271. According to this method, the repairing of the surface coatings as in the pulse laser method is not required and also the base metal is not evaporated, so that a high lamination factor can be maintained. On the other hand, in case of laser beam irradiation, the absorption of laser beam becomes a problem, resulting from the inevitable change of color in the surface coating on the steel sheet or an inevitable change of absorption coefficient, and consequently the laser irradiation effect is not constant. On the contrary, in case of plasma flame irradiation, the plasma flame is directly irradiated to the steel sheet, so that a stable effect is obtained even if the color of the steel surface is fluctuated, and consequently the iron loss values after the irradiation is low as compared with that experienced after laser irradiation.

SUMMARY OF THE INVENTION

The invention is directed to more greatly improve the effect of reducing the iron loss through plasma flame irradiation, and has been accomplished on the basis of such new knowledge that the irradiation interval is related to the secondary recrystallized grain size in the plasma flame irradiation.

According to the invention, there is the provision of a method of reducing iron loss of a grain oriented silicon steel sheet by irradiating a plasma flame to the surface of the grain oriented silicon steel sheet after final annealing, characterized in that said plasma flame is irradiated in a direction across the rolling direction of the steel sheet at an irradiation interval satisfying the following equation (1):

$$22-2.5D \leqq l \leqq 36-2.5D \quad (1)$$

wherein D is the average secondary recrystallized grain size (mm) of the steel sheet and l is the irradiation interval (mm).

BRIEF DESCRIPTION OF THE DRAWINGS

The invention will be described with reference to the accompanying drawings, wherein.

DESCRIPTION OF THE PREFERRED EMBODIMENTS

The invention will be described with respect to experimental details resulting in the success of the invention.

After the silicon steel sheet was subjected to final annealing and further to an insulation coating, it was subjected to plasma flame and laser beam irradiations in a direction perpendicular to the rolling direction of the steel sheet, respectively. The plasma flame was irradiated through a nozzle hole of 0.1~0.3 mm in diameter using Ar as the plasma gas. On the other hand, the laser beam irradiation was carried out by using pulse oscillation and continuous oscillation of a YAG laser, respectively. The power density of the laser was low in case of continuous oscillation and high in case of pulse oscillation and was within a range of $10^5 \sim 10^8$ W/cm$^2$.

The plasma flame and laser beam irradiations were performed on a steel sheet having an average secondary recrystallized grain size of 6.3 mm in a direction perpendicular to the rolling direction of the steel sheet by changing the irradiation interval l (mm) within a range of 3~20 mm and then the iron loss value $W_{17/50}$ was measured with a single sheet tester.

Figure 1:
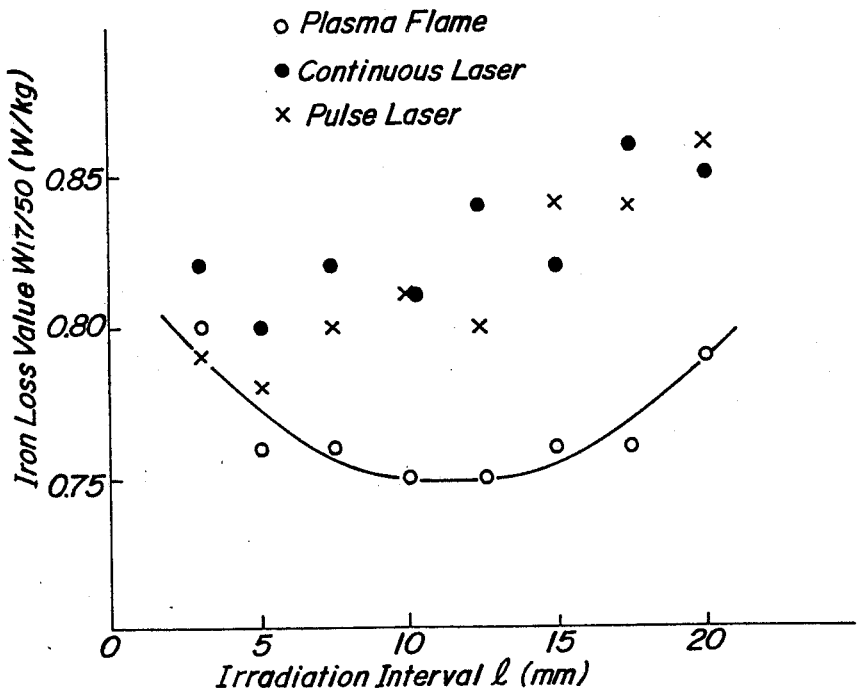
FIG. 1 is a graph showing the relation between irradiation interval and iron loss value after plasma flame and laser beam irradiations.

The obtained results are shown in FIG. 1. In this experiment, the thickness of the steel sheet was 0.23 mm, and the iron loss value before the above treatment was 0.94~0.96 W/kg.

As shown in FIG. 1, in case of the laser irradiation, the iron loss value after irradiation decreases as the irradiation interval of the pulse laser beam or continuous laser beam becomes shorter, while in the case of plasma flame irradiation, the minimum value of iron loss was observed at the interval near to l=12~13 mm and the minimum iron loss value was fairly low as compared with that of the laser beam irradiation. In this experiment, the removal of surface coatings and base metal by the pulse laser beam irradiation was observed, while damage of the coatings by the plasma flame irradiation was not observed.

Figure 2:
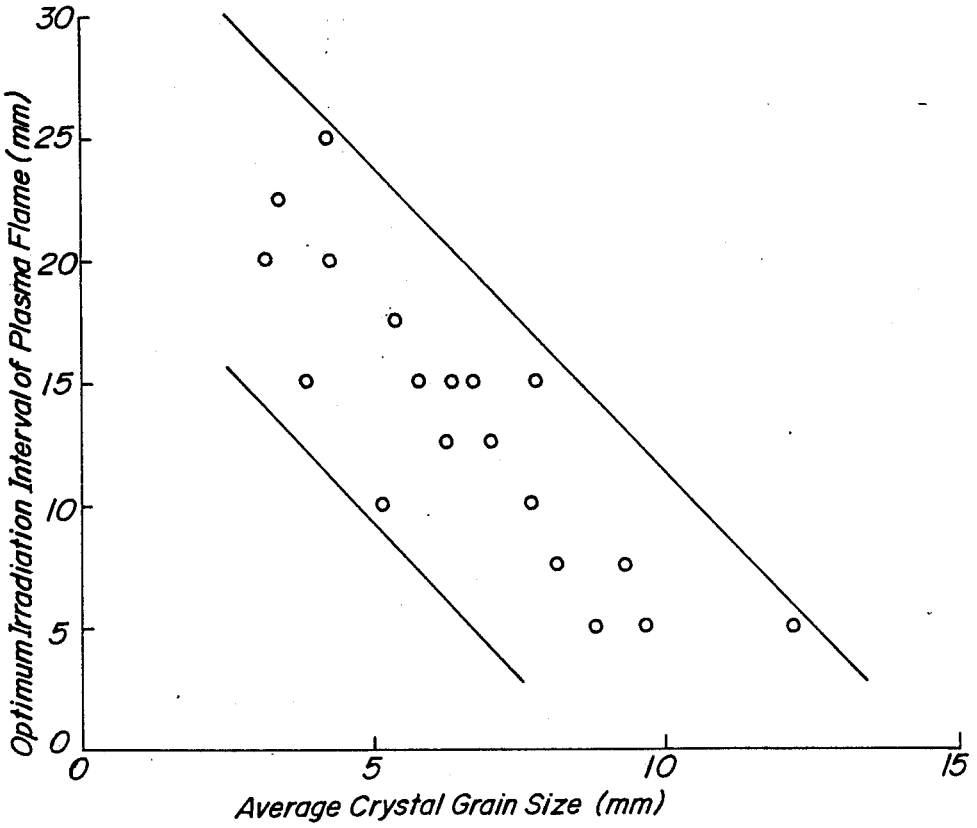
FIG. 2 is the graph showing a relation between average secondary recrystallized grain size and optimum plasma flame irradiation interval.

Assuming that the optimum irradiation interval for minimizing the iron loss value is influenced by the secondary recrystallized grain size, the final annealed steel sheets having an average secondary recrystallized grain size of 3~15 mm were subjected to plasma flame and laser beam irradiations in the same manner as described above, whereby the optimum irradiation interval l for minimizing the iron loss value was investigated. If the optimum irradiation interval has a certain range, the maximum value is defined as the optimum irradiation interval. The results are shown in FIG. 2.

In case of laser beam irradiation, the optimum irradiation interval is invariable within a constant range of 5~7.5 mm even when varying the crystal grain size. On the other hand, in case of the plasma flame irradiation, the behavior is largely different from that of the laser irradiation, and the smaller the average crystal grain size, the wider the irradiation interval as shown in FIG. 2. The range of the optimum irradiation interval shown in FIG. 2 is represented by the following equation (1) where the average crystal grain size is D (mm) and the optimum irradiation interval is l (mm):

$$22-2.5D \leqq l \leqq 36-2.5D \quad (1)$$

Therefore, the lowest value of iron loss is obtained by properly selecting the irradiation interval within the above range.

As mentioned above, the plasma flame irradiation exhibits a behavior different from that of the laser beam irradiation and gives a lower iron loss. This may be explained as follows. In case of the pulse laser irradiation, the laser beam is absorbed by the steel sheet and then evaporates the surface coating and a part of the base metal, generating shock waves which improve a strain upon the steel sheet. The continuous laser beam is also absorbed by the steel sheet and gives a thermal strain to the steel sheet. In case of plasma flame irradiation, direct heating by the high temperature plasma flame gives a strain to the steel sheet so that the unstability of the introduction of strain due to the inevitable fluctuation of light beam absorption coefficient of the steel sheets as seen in the laser irradiation is eliminated. Not only the direct heating but also the impact force of the plasma particles can introduce a stable strain to the steel sheets, resulting in very low iron loss in case of plasma flame irradiation.

Steel sheets finally annealed or subjected to secondary recrystallization annealing in the well-known method are advantageously adapted as the steel sheet used in the invention. In this case, there is no problem on the presence or absence and kind of the surface coating on the steel sheet surface. Of course, it is acceptable to make the steel surface into a mirror finished state by polishing.

Figure 3:
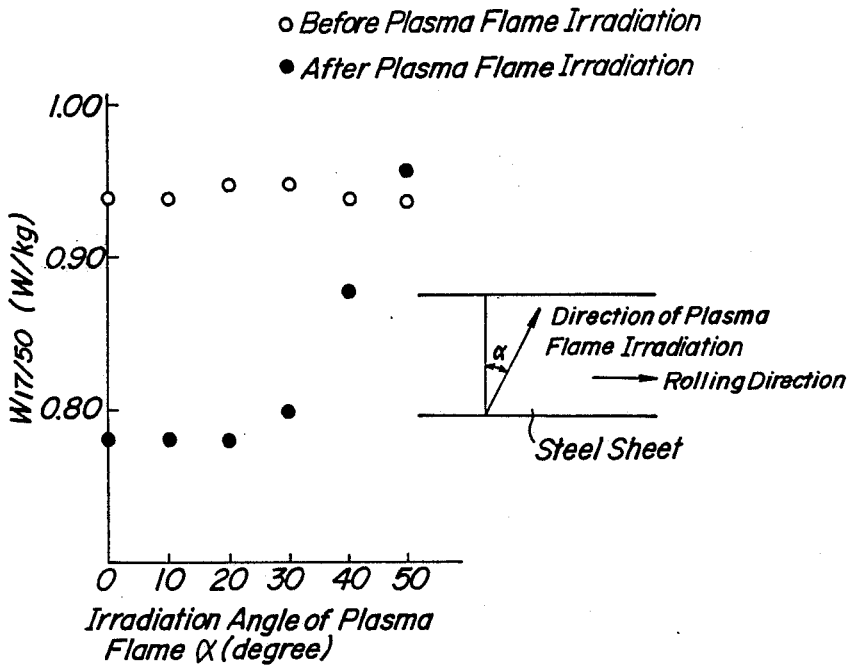
FIG. 3 is the graph showing a relation between irradiation direction of plasma flame and the iron loss value before and after the irradiation.

According to the invention, the average secondary recrystallized grain size is first measured and then the plasma flame is irradiated at an adequate irradiation interval determined by the equation (1). In this case, the irradiation direction is most preferably in a direction perpendicular to the rolling direction of the steel sheet, but it may be varied within a range of about ±30° from the direction perpendicular to the rolling direction as shown in FIG. 3. The results shown in FIG. 3 were obtained by irradiating the plasma flame to the steel sheet of 0.23 mm in thickness at various irradiation angles.

The average secondary recrystallized grain size is defined as the average grain diameter assuming that the secondary recrystallized grain is a circle, and is calculated from the number of crystal grains existing in a given area.

As mentioned above, according to the invention, the effect of the irradiation of plasma flame can be developed at the maximum and also the irradiation interval can be widened as compared with that of laser irradiation, so that the reduction of iron loss can easily be achieved industrially.

The invention will be described with reference to the following example.

Example

There were provided two finally annealed grain oriented silicon steel sheets having an average secondary recrystallized grain size (D) of 4.1 mm (steel sheet A) and 11.5 mm (steel sheet B). To these steel sheets was irradiated a plasma flame at an irradiation interval of 5 mm, 10 mm or 15 mm in a direction perpendicular to the rolling direction of the steel sheet. In this case, the plasma flame was irradiated through a nozzle of 0.30 mm in diameter using Ar as a plasma gas. The plasma current was 10 A and the scanning speed of the plasma torch was 1,000 mm/s.

The magnetic properties before and after plasma flame irradiation were measured with a single sheet tester and the results are shown in the following Table 1.

| Steel sheet (grain size) | Interval of plasma flame irradiation (mm) | Magnetic properties before irradiation | | Magnetic properties after irradiation | | Remarks |
|---|---|---|---|---|---|---|
| | | $B_{10}$ (T) | $W_{17/50}$ (W/kg) | $B_{10}$ (T) | $W_{17/50}$ (W/kg) | |
| A (4.1 mm) | 5 | 1.93 | 0.89 | 1.93 | 0.80 | Comparative example |
| | 10 | 1.93 | 0.90 | 1.93 | 0.78 | Comparative example |
| | 15 | 1.93 | 0.89 | 1.93 | 0.75 | Acceptable example |

-continued

| Steel sheet (grain size) | Interval of plasma flame irradiation (mm) | Magnetic properties before irradiation | | Magnetic properties after irradiation | | Remarks |
|---|---|---|---|---|---|---|
| | | $B_{10}$ (T) | $W_{17/50}$ (W/kg) | $B_{10}$ (T) | $W_{17/50}$ (W/kg) | |
| B (11.5 mm) | 5 | 1.93 | 0.94 | 1.93 | 0.74 | Acceptable example |
| | 10 | 1.93 | 0.94 | 1.93 | 0.79 | Comparative example |
| | 15 | 1.93 | 0.95 | 1.93 | 0.83 | Comparative example |

As seen from Table 1, good iron loss properties are particularly obtained when the equation (1) is satisfied.

Then, the plasma flame was irradiated in a direction displaced by 15° from the direction perpendicular to the rolling direction of the steel sheet under the same conditions as in the acceptable example.

As a result, the iron loss ($W_{17/50}$) was 0.75 W/kg in case of the steel sheet A and 0.74 W/kg in case of the steel sheet B. These values were the same as in the case when the plasma flame was irradiated in a direction perpendicular to the rolling direction.

As mentioned above, according to the invention, the iron loss can be reduced efficiently and in large amount, which considerably contributes to energy-saving in actual transformers and the like.

What is claimed is:

1. A method of reducing iron loss of a grain oriented silicon steel sheet by irradiating a plasma flame at an irradiation interval to the surface of the grain oriented silicon steel sheet after final annealing, characterized in that said plasma flame is irradiated in a direction across the rolling direction of the steel sheet, said irradiation interval satisfying the following equation (1):

$$22-2.5D \leqq l \leqq 36-2.5D \quad (1)$$

wherein D is the average secondary recrystallized grain size (mm) of the steel sheet and l is the irradiation interval (mm).

2. The method according to claim 1, wherein said plasma flame is irradiated in a direction displaced within a range of ±30° from a direction perpendicular to said rolling direction.

* * * * *

UNITED STATES PATENT AND TRADEMARK OFFICE

CERTIFICATE OF CORRECTION

PATENT NO. : 4,915,749

DATED : April 10, 1990

INVENTOR(S) : Bunjiro Fukuda et al

It is certified that error appears in the above-identified patent and that said Letters Patent is hereby corrected as shown below:

Column 2, line 42, delete "a" and insert therefor --the--.

Column 2, line 45, delete "a" and insert therefor --the--.

Column 3, line 54, delete "improve" and insert therefor --impose--.

Signed and Sealed this

Thirtieth Day of June, 1992

*Attest:*

DOUGLAS B. COMER

*Attesting Officer*

*Acting Commissioner of Patents and Trademarks*